US008056478B2

(12) United States Patent
Berlin et al.

(10) Patent No.: US 8,056,478 B2
(45) Date of Patent: Nov. 15, 2011

(54) METHODS AND APPARATUS FOR HIGH-IMPULSE FUZE BOOSTER FOR INSENSITIVE MUNITIONS

(75) Inventors: Bryan F. Berlin, Tucson, AZ (US); Kim L. Christianson, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 272 days.

(21) Appl. No.: 12/429,811

(22) Filed: Apr. 24, 2009

(65) Prior Publication Data

US 2010/0294156 A1 Nov. 25, 2010

(51) Int. Cl.
*C06C 5/06* (2006.01)
*C06B 21/00* (2006.01)

(52) U.S. Cl. ..... 102/275.11; 102/305; 102/202

(58) Field of Classification Search ..... 102/202, 102/305, 209, 275.11, 309
See application file for complete search history.

(56) References Cited

U.S. PATENT DOCUMENTS

| | | | | | |
|---|---|---|---|---|---|
| 3,027,838 | A | * | 4/1962 | Meddick | 102/309 |
| 3,410,212 | A | * | 11/1968 | Drimmer | 102/428 |
| 3,802,342 | A | * | 4/1974 | Berlot et al. | 102/309 |
| 4,342,261 | A | | 8/1982 | Majerus | |
| 4,594,946 | A | | 6/1986 | Ringel et al. | |
| 4,632,036 | A | | 12/1986 | Ringel | |
| 4,672,896 | A | * | 6/1987 | Precoul et al. | 102/309 |
| 4,711,181 | A | * | 12/1987 | Ringel et al. | 102/476 |
| 4,875,414 | A | * | 10/1989 | Stadler et al. | 102/307 |
| H000913 | H | * | 5/1991 | Hershkowitz | 102/307 |
| 5,187,319 | A | * | 2/1993 | Nouguez et al. | 102/202.1 |
| 5,259,317 | A | * | 11/1993 | Lips | 102/307 |
| 5,847,312 | A | * | 12/1998 | Walters et al. | 102/309 |
| 7,752,972 | B1 | * | 7/2010 | Baker et al. | 102/309 |

FOREIGN PATENT DOCUMENTS

| | | |
|---|---|---|
| WO | WO-2010011243 A1 | 1/2010 |
| WO | WO-2010011243 A9 | 4/2010 |

OTHER PUBLICATIONS

"International Application Serial No. PCT/US2009/002538, Search Report mailed Jan. 7, 2010", 2 pgs.
"International Application Serial No. PCT/US2009/002538, Written Opinion mailed Jan. 7, 2010", 10 pgs.

* cited by examiner

*Primary Examiner* — James Bergin
(74) *Attorney, Agent, or Firm* — Schwegman, Lundberg & Woessner, P.A.

(57) ABSTRACT

A method for initiating a low-sensitivity explosive charge includes initiating a booster explosive charge within an explosive charge cavity in a booster housing, and generating a planar detonation wave. Generating the planar detonation wave includes directing a detonation wave through the booster housing along a first waveshaper surface of a detonation waveshaper. The detonation wave is directed around the first waveshaper surface toward a second tapered waveshaper surface. After progressing around the first waveshaper surface, the detonation wave is directed along the second tapered waveshaper surface. The detonation wave changes into a planar detonation wave as the detonation wave moves along the second tapered waveshaper surface, the planar detonation wave includes a planar wave front. The planar detonation wave strikes a flyer plate coupled over the explosive charge cavity of the booster housing, and the planar wave front makes planar contact along an inner face of the flyer plate.

35 Claims, 8 Drawing Sheets

METHODS AND APPARATUS FOR HIGH-IMPULSE FUZE BOOSTER FOR INSENSITIVE MUNITIONS

CROSS REFERENCE TO RELATED APPLICATION(S)

This patent application relates to U.S. patent application Ser. No. 61/048,110 entitled "APPARATUS AND METHODS FOR INTEGRAL THRUST VECTOR AND CONTROL" filed Apr. 25, 2008, the entire contents of which are hereby incorporated in its entirety.

TECHNICAL FIELD

Initiation of low-sensitivity explosives.

BACKGROUND

Fuze systems, such as those used to initiate detonation of warheads in artillery shells, missiles, projectiles, or the like, must satisfy high performance criteria. These requirements have driven the direction of both mechanical and energetic materials designs. Energetic materials technology has moved to the use of explosive formulations that are less shock sensitive and have large critical diameters. The reduced shock sensitivity and large critical diameter focus serves to reduce the threat of hazard potential for impact shocks by bullet, fragments, and sympathetic detonation scenarios. This effect, while positive for meeting insensitive munitions requirements poses challenges for the fuze and initiation train designers who have to achieve reliable, prompt initiation of the explosive formulations during warhead function.

The maturing energetic material formulations have two different additional characteristics that further increase the difficulty of achieving proper initiation. The first is that many of the formulations are cast cured compounds that have a shrinkage rate upon curing. This potentially creates gaps between the fuze booster face and the bare explosive surface of the warhead. The second characteristic is based on design and terminal impact environments. The column height of the explosive fill, coupled with the dynamic impact decelerations causes the explosive to deform plastically, or flow, in the forward direction effectively increasing the booster gap in the aft-initiation design payloads. Prompt initiation of the insensitive munition explosive formulation requires a pressure front of sufficiently high magnitude and lengthy time period. The terminal conditions with various gaps require the high-impulse shock to be delivered across the gap.

Conventional booster designs have lightweight metal can designs that fail to deliver the pulse-length/high pressure shock front with uniformity into the explosive fill. The result is that the designs have low reliability and are much more likely to dud due to explosive shock quenching. Prior systems have attempted to compensate by placing a reduced size plug in the warhead representing the fuze during explosive loading in an attempt to minimize the gap between the fuze, booster and the explosive fill after curing. Since the shrinkage is a function of many parameters and can not be accurately predicted, this reduced but did not eliminate the gap. Additionally this process does not eliminate the explosive fill forward slosh during the terminal impact conditions.

SUMMARY

Methods and apparatus for high-impulse boosters according to various aspects of the present subject matter comprise a system for initiating the detonation of an explosive. In one embodiment, the system comprises an explosive train including a waveshaper and a flyer plate to control and direct the explosive train to detonate an insensitive munition.

BRIEF DESCRIPTION OF THE DRAWINGS

A more complete understanding of the present subject matter may be derived by referring to the detailed description and claims when considered in connection with the following illustrative figures. In the following figures, like reference numbers refer to similar elements and steps throughout the figures.

Elements and steps in the figures are illustrated for simplicity and clarity and have not necessarily been rendered according to any particular sequence. For example, steps that may be performed concurrently or in different order are illustrated in the figures to help to improve understanding of embodiments of the present subject matter.

DESCRIPTION OF THE EMBODIMENTS

In the following detailed description, reference is made to the accompanying drawings which form a part hereof, and in which is shown by way of illustration specific embodiments in which the subject matter may be practiced. These embodiments are described in sufficient detail to enable those skilled in the art to practice the subject matter, and it is to be understood that other embodiments may be utilized and that structural changes may be made without departing from the scope of the present subject matter. Therefore, the following detailed description is not to be taken in a limiting sense, and the scope of the present subject matter is defined by the appended claims and their equivalents.

The present subject matter may be described in terms of functional block components and various processing steps. Such functional blocks may be realized by any number of techniques, technologies, and methods configured to perform the specified functions and achieve the various results. For example, the present subject matter may employ various materials, actuators, electronics, shape, airflow surfaces, reinforcing structures, explosives and the like, which may carry out a variety of functions. In addition, the present subject matter may be practiced in conjunction with any number of devices, and the systems described are merely exemplary applications. Further, the present subject matter may employ any number of conventional techniques for initiating explosives, storing explosive materials, reinforcing housings, controlling detonations, arming delays, functioning delays, mixing explosive compounds, employing sensors, safeties, manufacturing explosives, housings and munition elements, and the like.

Figure 1:
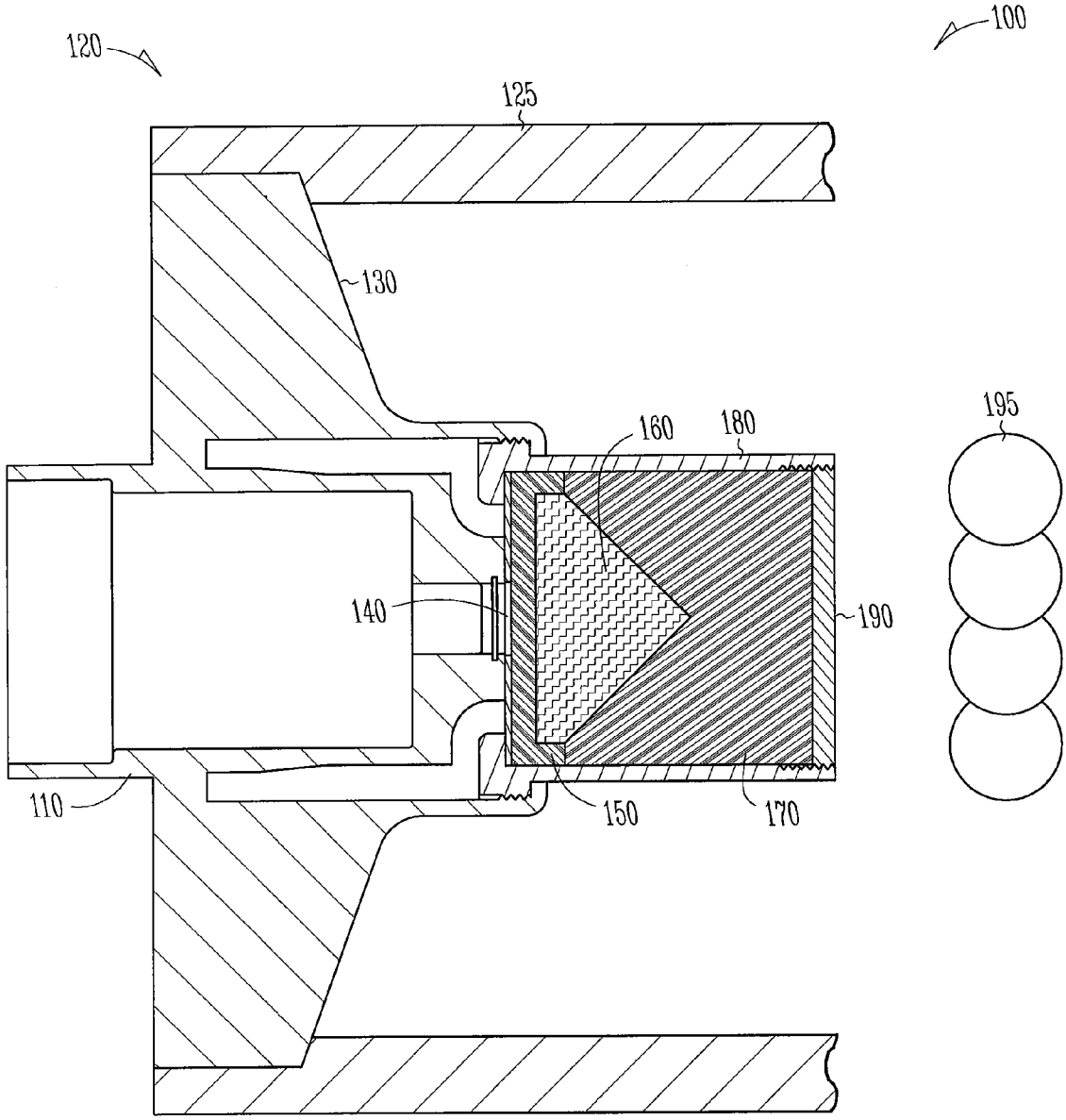
FIG. 1 is a partial side view of a munition housing including one example of a booster housing and a waveshaper.

Referring to FIG. 1, a high-impulse fuze booster system 100 according to various aspects of the present subject matter is implemented in conjunction with a munition 120. The munition 120 comprises the munition housing 125, the fuze housing 110, a booster housing 180, a booster initiation lead 140, a transfer charge 150, a detonation waveshaper 160, a booster explosive charge 170, a high-impulse flyer plate 190 and a low-sensitivity explosive charge 195.

The munition 120 may comprise any appropriate system, such as a vehicle, rocket, missile, aircraft, guided or unguided bomb, submarine, propeller, turbine, artillery shell, or torpedo. In the present example, the munition 120 comprises a bomb, such as a military unguided bomb for delivering a warhead. Accordingly, the munition 120 may include appropriate systems for the particular application or environment, such as guidance systems, reconnaissance equipment, warheads, sensors, communications equipment, cargo bays, crew interfaces, and propulsion systems. The munition 120 includes the munition housing 125 for containing elements of the munition 120.

The munition housing 125 may include any suitable structure for containing at least a portion of the fuze housing 110 and payload. For example, the munition housing 125 houses the components of a bomb or missile system and may include any suitable material such as steel, hardened steel, ceramics, cellulose, other materials such as military artillery tubes, or combinations of the same. In the present example shown in FIG. 1, the munition housing 125 contains at least a portion of the components of the fuze housing 110 including the fuze well 130 and other components of the high-impulse fuze booster system 100 such as the booster explosive charge 170 and the booster housing 180. The munition housing 125 is constructed in any suitable configuration based upon the application. For instance, the munition housing 125 includes a bomb or missile casing capable of housing the high-impulse fuze booster system 100. In one application, the munition housing 125 is used in a free-fall condition such as some ground-penetrating bombs. Alternatively, the munition housing 125 may be used in propelled applications such as in rocket-powered ground penetrating or other propelled applications. In the case of ground penetrating munitions, the munition housing 125 may be configured to minimize the warhead case's cross-sectional area and air resistance. Other applications require a munition housing 125 having a substantially different configuration. The munition housing 125 may be formed by any suitable process including, but not limited to, molding, machining, forcing, extruding and the like.

One example of the high-impulse fuze booster system 100 is shown in FIG. 1. The high-impulse fuze booster system 100, as shown in FIG. 1, is part of the munition 120. The high-impulse fuze booster system 100 is positioned within the munition housing 125. As shown in FIG. 1, in one example, a fuze well 130 extends from the munition housing 125 and positions the fuze housing 110 and booster housing 180 within the munition 120. The high-impulse fuze booster system 100 is configured to initiate detonation of the low-sensitivity explosive charge 195. The low-sensitivity explosive charge 195 is configured to initiate detonation upon reception of a high speed impact from the fuze booster system 100. As shown in FIG. 1, the fuze housing 110 is coupled with the fuze well 130. In one example, the fuze housing 110 is an integral portion of the fuze well 130. Optionally, the fuze housing 110 is a separate piece from the fuze well 130 and connected to the fuze well 130 with coupling features including, but not limited to, mechanical fittings, threading, welds, adhesives, and the like. The booster housing 180 shown in FIG. 1 is coupled with the fuze housing 110. As shown in FIG. 1, a booster initiation lead 140 extends from the fuze housing 110 into the booster housing 180. In one example, the booster housing 180 is integrally formed with the fuze housing 110. In another example, the booster housing 180 is configured for coupling with the fuze housing 110 in a non-integral manner with similar features used to couple the fuze housing 110 with fuze well.

As described above, the fuze housing 110 is coupled to a fuze well 130. In one example, the fuze well 130 is coupled to the munition housing 125. In another example, the fuze housing 110 is coupled to the munition housing 125. This coupling may be through any suitable means including but not limited to, welds, mechanical fittings, adhesives, intermediate framing and the like. In the example shown in FIG. 1, the fuze well 130 outer surface including the fuze housing 110 is configured to couple to an inner surface of the munition housing 125. For example, an outer surface of the fuze housing is welded to a portion of the munition housing 125. In the example of FIG. 1, a portion of the outer surface of the fuze well 130 (and fuze housing 110) is welded to an inner surface of the munition housing 125. The fuze housing 110 is couple to the munition housing 125 in any suitable manner in other examples including, but not limited to, mechanical fittings (bolts, screws, pins and the like), interference and friction fits, adhesives and the like. The fuze housing 110 is retained within the munition housing 125 or coupled externally to the munition housing 125. Alternatively, the fuze housing 110 is included in the interior wall of the munition housing 125. In other examples, the fuze housing 110 is located in any suitable position or orientation capable of initiating the detonation of the low-sensitivity explosive charge 195. In the example shown in FIG. 1, the fuze housing 110 is located in the tail portion of the munition 120. The fuze housing 110 is fabricated out of any suitable material, and in any configuration suitable for performing its function including, but not limited to, steel, hardened steel, other metals and the like.

Referring again to FIG. 1, the booster housing 180 receives the booster initiation lead 140 at one end of the booster housing. The booster initiation lead is positioned adjacent to a booster explosive charge 170. The booster explosive charge 170 includes a transfer charge 150 positioned within the booster housing 180 adjacent to the fuze housing 110. The transfer charge 150 extends around the detonation waveshaper 160 into contact with the remainder of the booster explosive charge 170. The booster explosive charge includes the transfer charge 150. In one example, the booster explosive charge 170 and transfer charge 150 are a single integral explosive extending around the waveshaper 160. In still another example, the booster explosive charge 170 includes a separate transfer charge 150 including a different explosive material from the remainder of the booster explosive charge 170 positioned on an opposed side of the waveshaper 160 and adjacent to the high-impulse flyer plate 190. The high-impulse flyer plate 190 is positioned at an end portion of the booster housing 180 opposed to the booster initiation lead 140. The waveshaper 160 is positioned between the high-impulse flyer plate 190 and the booster initiation lead 140.

As will be described in further detail below, the waveshaper 160 is positioned within the booster explosive charge 170 (e.g., including the transfer charge 150) to shape the detonation wave initiated at the booster initiation lead 140 within the transfer charge 150. The waveshaper 160 directs the detonation wave around the waveshaper and forms the detonation wave into a planar detonation wave having a planar detonation wave front. The planar detonation wave front strikes the high-impulse flyer plate 190 to project the high-impulse flyer plate 190 away from the booster housing 180. The high-impulse flyer plate 190 impacts against the low-sensitivity explosive charge 195. The planar detonation wave maintains the high-impulse flyer plate 190 in a substantially parallel orientation to the plane defined by the planar detonation wave front. The high-impulse flyer plate is thereby able to make immediate planar contact with a plurality of surfaces of the low-sensitivity explosive charge 195. That is, the planar detonation wave front created by the waveshaper 160 maintains the high-impulse flyer plate 190 in a constant trajectory where the high-impulse flyer plate 190 does not tilt or rotate thereby ensuring the high-impulse flyer plate 190 makes planar contact with the plurality of surfaces of the low-sensitivity explosive charge 195.

The booster housing 180 may include structure for housing the booster explosive charge 170 of the fuze booster system 100 during initiation of the booster explosive charge to direct the explosion of the booster explosive charge 170 into the flyer plate 190. The booster housing 180 is configured to couple to one or more components of the munition housing 125. For example, the booster housing 180 includes a metal housing into which the booster explosive charge 170 is installed. The booster housing 180 is constructed with any suitable material such as steel, hardened steel, or combinations of the same able to contain and direct the explosion of the booster explosive charge 170 toward the flyer plate 190. The booster housing 180 couples to the fuze housing 110 in any suitable manner. For instance, the booster housing 180 couples directly to the fuze housing 110 by a weld. In another example, the booster housing 180 is formed as part of the fuze housing 110 during construction of the fuze housing 110. For example, if the fuze housing 110 is constructed by molding, the booster housing 180 is incorporated into the mold. In the example shown in FIG. 1, the booster housing 180 is constructed separately from the fuze well 130 and then is removably coupled to the fuze housing 110. In still another example, an outer surface of the booster housing 180 includes a threaded surface that is configured to couple to a similarly threaded surface formed within a cavity defined by an outer surface of the fuze housing 110. Optionally, the booster housing 180 may be bolted, screwed, or pinned to the fuze housing 110. The booster housing 180 is coupled to the fuze housing 110 in any suitable manner.

The booster housing 180 is constructed with a material able to provide strong confinement during detonation to increase the ballistic efficiency of the high-impulse flyer plate 190 as it is launched from the booster housing 180. The booster housing 180 in combination with the detonation waveshaper 160 provides trajectory and rotation control of the high-impulse flyer plate 190 to reduce angular tipoff of the flyer plate 190 prior to impact with the low-sensitivity explosive charge 195.

The booster initiation lead 140 is coupled with the booster housing 180 and housed substantially within the fuze housing 110, in one example. In another example, the booster initiation lead 140 is housed substantially within the booster housing 180. The booster initiation lead 140 is coupled to the transfer charge 150 through any suitable fashion that facilitates initiation of the transfer charge 150. Additionally, the booster initiation lead 140 is positioned in a suitable orientation permitting triggering of the booster initiation lead when desired. Triggering of the booster initiation lead 140 includes, but is not limited to, force activation, control system activation, manual activation and the like. In the example shown in FIG. 1, the booster initiation lead 140 is triggered by a control system housed onboard the munition 120. The booster initiation lead 140 is constructed with any suitable material for initiating the transfer charge 150. Booster initiation lead 140 materials include materials that facilitate initiation by electronic, mechanical and chemical means.

Figure 2:
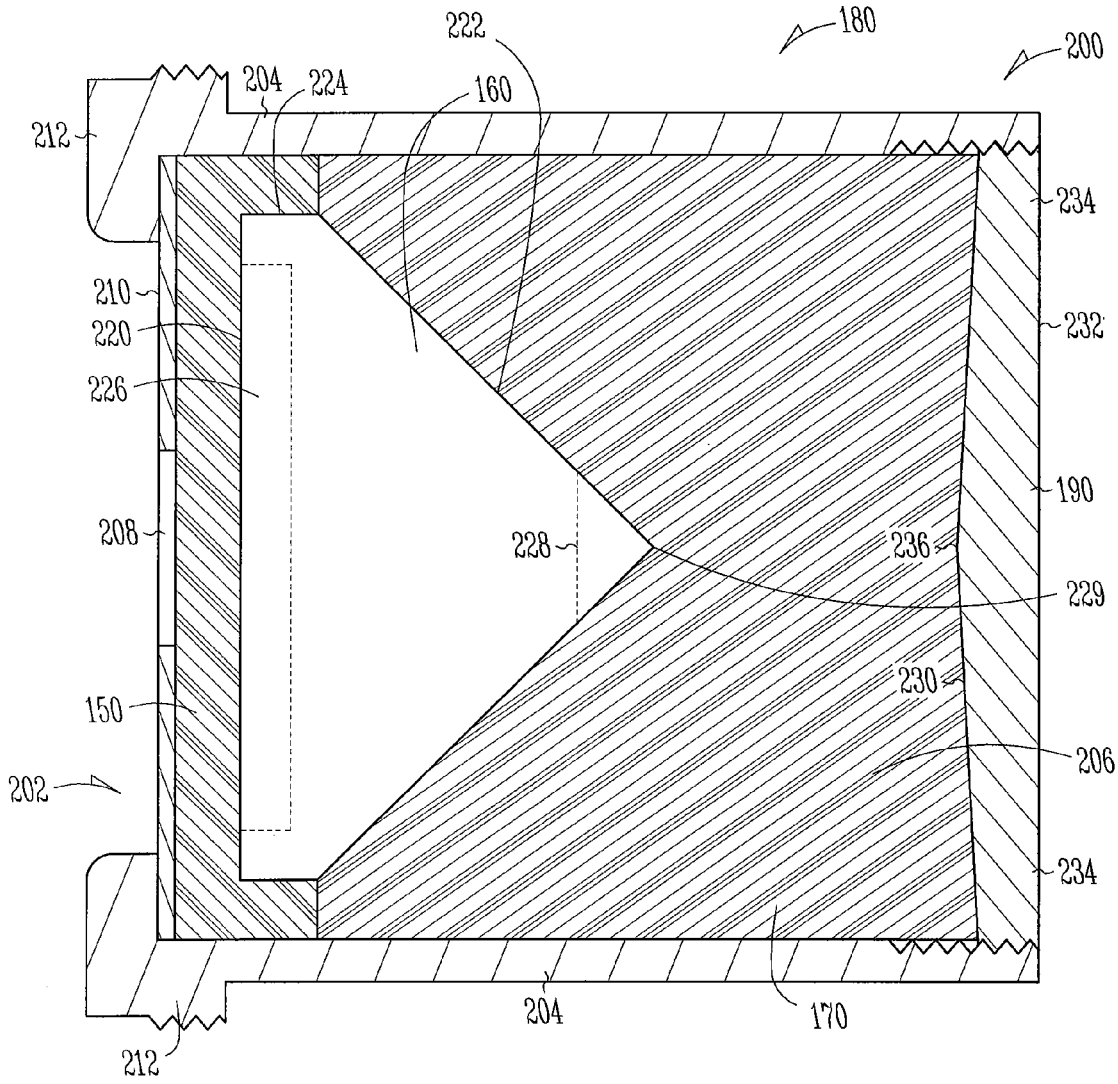
FIG. 2 is a cross-sectional view of the booster housing shown in FIG. 1.

Referring now to FIG. 2, one example of the booster housing 180 is shown including the detonation waveshaper 160 disposed therein. The booster housing 180 includes a booster housing first end portion 200 and a booster housing second end portion 202. A booster housing sidewall 204 extends between the first and second booster housing end portions 200, 202. The booster housing 180, in one example, is constructed with but not limited to steel, hardened steel, and other materials with structural integrity to withstand and direct a detonation wave generated within a booster housing explosive charge cavity 206 of the booster housing 180. In another example, the booster housing 180 has a cylindrical shape defined by the booster housing sidewall 204 with the end portions 200, 202. A booster initiation lead orifice 208 extends through the booster housing second end portion 202 facilitating communication between the fuze housing 110 (shown in FIG. 1) and the explosive charge cavity 206 of the booster housing 180. When the booster housing 180 is installed within the munition 120 the booster initiation lead 140 (described above) is fitted between the fuze housing 110 and the booster housing 180 through the booster initiation lead orifice 208. The booster initiation lead 140 contacts the booster explosive charge 170, including the transfer charge 150, to initiate detonation of the booster explosive charge 170 and provide the planar detonation wave configured to project the flyer plate 190 away from the booster housing 180.

The booster housing 180 further includes a booster housing end surface 210 extending across the booster housing sidewall 204. The booster initiation lead orifice 208 extends through the booster housing end surface 210, in one example. The booster housing second end portion 202 further includes a booster housing flange 212. Where the booster housing 180 is a non-integral piece to the fuze housing 110 the booster housing flange 212 provides for coupling of the booster housing 180 with the fuze housing 110. In one example, the booster housing flange 212 has coupling features configured to couple the booster housing 180 with the fuze housing 110. As described with the booster housing 180 above, coupling features include but are not limited to threading, mechanical fittings (e.g., interference fittings, friction fittings, and the like), pins, bolts, screws, welds, and the like.

As shown in FIG. 2, the booster explosive charge 170 includes in one example the transfer charge 150. The transfer charge 150 is oriented within the booster housing to contact the detonation waveshaper 160. The booster explosive charge 170 is formed with, but not limited to, high explosives for metal accelerating applications including PBXN-9, PBXW-11 or any other high explosive capable of accelerating metal towards the low-sensitivity explosive charge 195 and initiating detonation. In one example, the transfer charge 150 includes a first explosive and the booster explosive charge 170 positioned on the opposing side of the waveshaper 160 includes a second explosive. For instance, the transfer charge 150 includes PBXN-9 and the booster explosive charge 170 on the opposed side of the waveshaper 160 includes PBXW-11. The explosives chosen for the booster explosive charge 170 include any combination of explosives to achieve the proper detonation wave and detonation force from the booster housing 180 into the flyer plate 190.

Referring again to FIG. 2, the flyer plate 190 is shown coupled with the booster housing 180. In one example, the flyer plate 190 is integrally formed with the booster housing 180. In another example, the flyer plate 190 is coupled with the booster housing 180 through coupling features including but not limited to welds, threading, mechanical fittings (such as interference fits, friction fits and the like), bolts, screws, pins, and the like. As shown in FIG. 2, the flyer plate 190 includes a flyer plate interior surface 230 and a flyer plate exterior surface 232. The flyer plate interior surface 230, in one example, is immediately adjacent to the booster explosive charge 170.

In another example, the flyer plate 190 includes a slight taper along the flyer plate interior surface 230. As shown in FIG. 2, the flyer plate interior surface 230 tapers from near the flyer plate perimeter portion 234 to near the flyer plate center portion 236. In still another example, the flyer plate interior surface 230 is substantially planar and parallel to the flyer plate exterior surface 232.

Flyer plate 190 is constructed with, but not limited to steel, hardened steel and other materials with structural integrity to maintain the flyer plate 190 in a substantially planar configuration when subjected to the forces of the planar detonation wave front during projection of the flyer plate 190 from the booster housing 180 into contact with the low-sensitivity explosive charge 195 shown in FIG. 1. The flyer plate 190 is constructed to have a particularly high weight to ensure the flyer plate 190 strikes the low-sensitivity explosive charge 195 with sufficient force to initiate detonation of the low-sensitivity explosive charge. Additionally, the flyer plate 190 is constructed with a heavy weight material to ensure the flyer plate contacts and then remains in contact with the low-sensitivity explosive charge 195 to fully deliver the impact force from the planar detonation wave front over a longer period of time and thereby further ensure initiation of the low-sensitivity explosive charge 195.

One example of the detonation waveshaper 160 is shown in FIG. 2. The detonation waveshaper 160 includes a first waveshaper surface 220 and a second tapered waveshaper surface 222. The first waveshaper surface 220 extends radially away from a region of the booster housing 180 adjacent to the booster initiation lead orifice 208. The first waveshaper surface 220 extends towards the booster housing sidewall 204, in one example. A waveshaper edge 224 extends around the waveshaper 160 and is adjacent to the booster housing sidewall 204. The second tapered waveshaper surface 222 provides the detonation waveshaper 160 with a conical geometry. As shown in FIG. 2, in one example, the conical geometry of the second tapered waveshaper surface 222 extends to a point 229 near the flyer plate center portion 236. As described further below, the booster explosive charge 170 extends along the conical geometry of the second tapered waveshaper surface 222 toward the flyer plate 190.

The detonation waveshaper 160 is positioned substantially within the booster housing 180. The detonation waveshaper 160 comprises any suitable structure for transitioning a wave front. The detonation waveshaper 160 is oriented such that it transitions the detonation wave front of the transfer charge 150 into a planar detonation wave front, as described below. In other examples, the detonation waveshaper 160 is used in conjunction with shaped charges and other waveguides. In the example shown in FIGS. 1 and 2, the waveshaper is shaped such that a spherical detonation wave front is transitioned into a planar detonation front.

As previously described, the booster explosive charge 170, in one example, includes a transfer charge 150. The transfer charge 150 extends along the first waveshaper surface 220 toward the booster housing sidewall 204. The transfer charge 150 is thereby coupled between the first waveshaper surface 220 and the booster housing end surface 210. The booster explosive charge 170 (e.g., transfer charge 150) then extends around the waveshaper 160 adjacent to the waveshaper edge 224. That is, the transfer charge 150 extends between the waveshaper 160 (e.g., the waveshaper edge 224) and the booster housing sidewall 204 toward the flyer plate 190. The booster explosive charge 170 extends from the waveshaper edge 224 over the second tapered waveshaper surface 222 toward the flyer plate 190. As shown in FIG. 2, the booster explosive charge 170 extends between the second tapered waveshaper surface 222 and the booster housing sidewall 204.

Upon initiation of the booster explosive charge 170 by the booster initiation lead 140 (see FIG. 1), the detonation wave proceeds from the booster initiation lead 140 radially along detonation paths extending through the transfer charge 150 toward the booster housing sidewall 204 and the waveshaper edge 224. The booster explosive charge 170 continues to initiate around the waveshaper 160 and the waveshaper edge 224. The detonation wave travels along the second tapered waveshaper surface 222 toward the flyer plate 190. The detonation path of the planar detonation wave across the second tapered waveshaper surface 222 transforms the detonation wave into a planar detonation wave having a planar detonation wave front. The planar detonation wave strikes against the flyer plate 190 projecting the flyer plate 190 from the booster housing 180 into contact with the low-sensitivity explosive charge 195 shown in FIG. 1.

The detonation waveshaper 160 is constructed with at least one material that substantially prevents transmission of the detonation wave through the waveshaper 160 toward the flyer plate 190. Instead, the detonation wave is substantially constrained to travel over the first waveshaper surface 220, around the waveshaper 160 and across the second tapered waveshaper surface 222 towards the flyer plate 190. As previously described and further described below, directing the detonation wave around the detonation waveshaper 160 and across the tapered waveshaper surface 222 transforms the detonation wave into a planar detonation wave.

Materials used in the construction of the waveshaper 160 include, but are not limited to, resin materials capable of withstanding the explosive force of the booster explosive charge 170 at least until the flyer plate 190 is projected away from the booster housing 180. That is, the detonation waveshaper 160 is constructed with materials that substantially resist deformation of the detonation waveshaper 160 until the flyer plate 190 is impacted into the low-sensitivity explosive charge 195 shown in FIG. 1. In one example, the waveshaper 160 is constructed with resin material including a polycarbonate resin thermal plastic such as LEXAN® a Registered Trademark of Sabic Innovative Plastics. Resins such as polycarbonate resins as well as other plastics, composites, steels and metals are capable of withstanding the forces of the detonation wave and thereby able to direct the detonation wave around the detonation waveshaper 160 to form the planar detonation wave to project the flyer plate 190 from the booster housing 180.

In another example shown in FIG. 2, the detonation waveshaper 160 includes a waveshaper insert 226. The waveshaper insert 226, shown in FIG. 2 is included as a portion of the first waveshaper surface 220 and is adjacent to the booster housing end surface 210. In one example, the waveshaper insert 226 has a disc like geometry that fits within a corresponding recess within the detonation waveshaper 160. Optionally, the waveshaper insert 226 is constructed of materials denser than those used in the remainder of the detonation waveshaper 160. Such materials include but are not limited to polycarbonate resin, thermoplastic, other plastics, metals, steels, and the like with structural integrity to ensure the detonation wave beginning at the booster initiation lead orifice 208 within the booster explosive charge 170 is directed around the detonation waveshaper 160 and thereafter along the second tapered waveshaper surface 222. The waveshaper insert 226 thereby acts as a shield for the remainder of the detonation waveshaper 160 to maintain the structural integrity of the detonation waveshaper 160 throughout the initiation of the booster explosive charge 170. In one example, the waveshaper insert 226 is formed with the remainder of the detonation waveshaper 160 such as by molding the separate materials in a single molding step. In yet another example, the waveshaper insert 226 is coupled with the remainder of the detonation waveshaper 160 by mechanical fittings, adhesives, welding, mechanical couplings, such as screws, bolts, pins, and the like.

As previously described, the second tapered waveshaper surface 222 is a taper extending from the waveshaper edge 224 toward the flyer plate 190. That is, the second tapered waveshaper surface 222 extends toward the flyer plate center portion 236. Optionally, the second tapered waveshaper surface 222 extends at any one of a variety of angles relative to the booster housing sidewall 204. As shown in the example in FIG. 2, the second tapered waveshaper surface 222 extends at a 45 degree angle relative to the booster housing sidewall 204. In still other examples, the second tapered waveshaper surface 222 extends at angles relative to the booster housing sidewall 204 from between about 15 degrees to 75 degrees.

In still another option, the second tapered waveshaper surface 222 tapers towards the flyer plate center portion 236 and includes a planar portion 228 substantially parallel to the first waveshaper surface 220. With the planar portion 228, the detonation waveshaper 160 has a substantially frusto-conical geometry. The frusto-conical geometry of the detonation waveshaper 160 with the second tapered waveshaper surface 222 ending at the planar portion 228 of the second tapered waveshaper surface is able to transform the detonation wave extending around the detonation waveshaper 160 into the planar detonation wave. That is to say the second tapered waveshaper surface 222 tapers to a point 229, a planar portion 228 and other geometries and is still able to transform the detonation wave into a planar detonation wave configured to impact and project the flyer plate 190 from the booster housing 180.

Figure 3A:
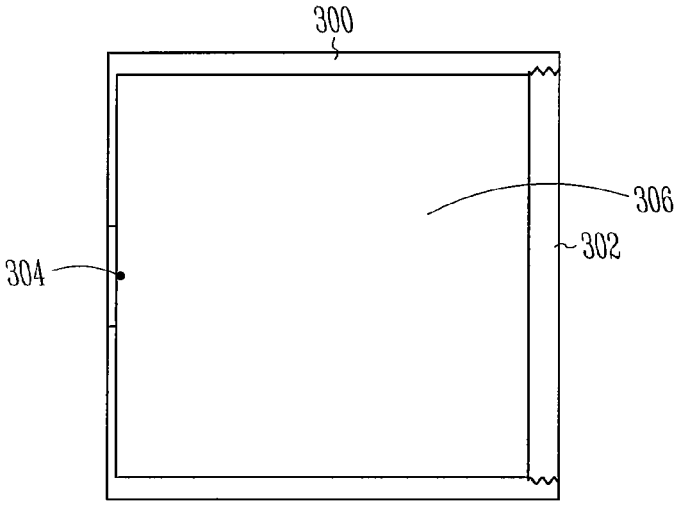
FIG. 3A is a side view of one example of a booster housing including a booster explosive charge without a waveshaper.
Figure 3B:
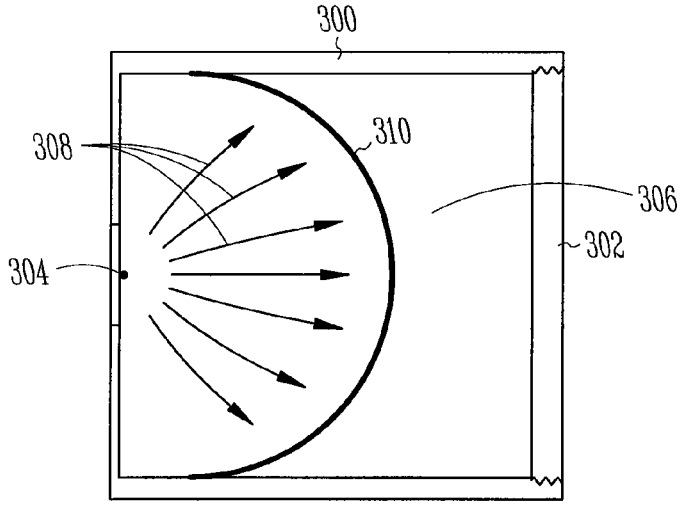
FIG. 3B is a side view of the booster housing shown in FIG. 3A with the booster explosive charge initiated and a spherical detonation wave progressing toward a flyer plate.
Figure 3C:
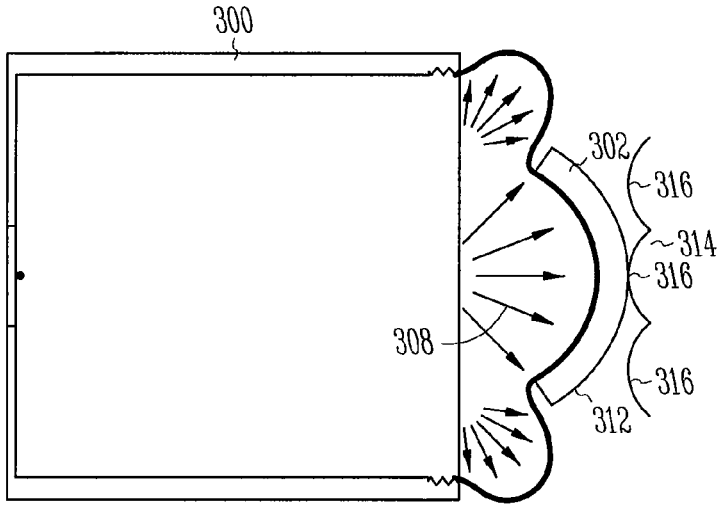
FIG. 3C is a side view of the booster housing shown in FIGS. 3A, B with the booster explosive charge initiated and a spherical detonation wave impacted against the flyer plate. The flyer plate impacts with the low-sensitivity explosive charge at a single point.

Referring now to FIGS. 3A through 3C, one example of a series of initiation steps with booster housing 300 without a detonation waveshaper, such as the detonation waveshaper 160 shown in FIGS. 1 and 2, is shown. Referring first to FIG. 3A, the booster housing 300 is shown with a booster initiation lead 304 and a booster explosive charge 306 positioned within the booster housing 300. A flyer plate 302 is coupled with the booster housing 300 at an opposed end of the booster housing 300 from the booster initiation lead 304.

Now referring to FIG. 3B, the booster explosive charge 306 is initiated, for instance, through the booster initiation lead 304. A detonation wave 308 progresses through the booster explosive charge 306 toward the flyer plate 302. As shown in FIG. 3B, the detonation wave 308 has a spherical detonation wave front 310. That is to say, the detonation wave 308 includes a wave front 310 that spherically progresses from the booster initiation lead 304 within the constraints of the booster housing 300. Because the detonation waveshaper 160 shown in FIGS. 1 and 2 is absent from the booster housing 300 shown in FIG. 3B, the detonation wave 308 naturally assumes the spherical shape with the spherical detonation wave front 310.

FIG. 3C shows the booster housing 300 after the spherical detonation wave front 310 (shown in FIG. 3B) of the detonation wave 308 strikes the flyer plate 302. As shown, the flyer plate 302 is projected away from the booster housing 300. The flyer plate 302 assumes a geometry roughly corresponding to the spherical detonation wave front 310 shown in FIG. 3B. That is, the flyer plate 302 is formed by the concussion of the spherical detonation wave front 310 into the curved geometry shown in FIG. 3C. The flyer plate 302 shown in FIG. 3C includes a curved exterior surface 312. The curved exterior surface 312 of the flyer plate 302 is unable to make planar contact with a plurality of surfaces 316 of the low-sensitivity explosive charge 314. Additionally, because of the uncontrolled nature of the detonation wave 308 the flyer plate 302 is susceptible to tilting relative to the low-sensitivity explosive charge 314. As shown in FIG. 3C, the flyer plate 302 is tilted clockwise and is tipped by inconsistencies in the spherical detonation wave 308. As will be described in further detail below, the control provided by the detonation waveshaper 160 ensures that the flyer plate 190 (shown in Figures and 2) projects from the booster housing 180 in a substantially planar orientation without rotation or tipping of the flyer plate 190 relative to the planar detonation wave front.

Referring again to FIG. 3C, as mentioned above, the curved exterior surface 312 of the flyer plate 302 is only able to engage one or a few surfaces of the low-sensitivity explosive charge 314 because of the non-planar geometry of the flyer plate 302. The initiation of the low-sensitivity explosive charge 314 is thereby not ensured. Instead, as previously described, to ensure initiation of the low-sensitivity explosive charge multiple contacts at a single time with sufficient force are needed along the low-sensitivity explosive charge to ensure that the charge initiates and detonates the munition.

Figure 4A:
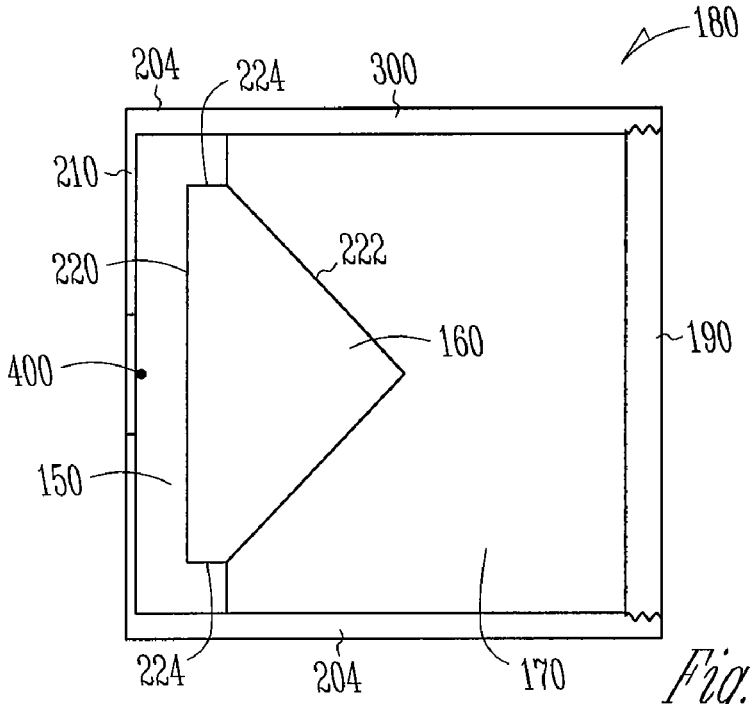
FIG. 4A is a side view of one example of a booster housing including a booster explosive charge and a waveshaper.

Referring now to FIGS. 4A through 4G, a staged progression of a detonation wave within the booster housing 180 is shown. At FIG. 4A, the detonation waveshaper 160 is positioned within the booster housing 180. The booster explosive charge 170 is positioned within the booster housing around the detonation waveshaper 160. In one example, as shown in FIG. 4A, the transfer charge 150 extends along the first waveshaper surface 220 adjacent to the booster initiation lead 400. The transfer charge 150 extends along the first waveshaper surface 220 and the booster housing end surface 210 toward the booster housing sidewall 204. That is, the transfer charge 150 is coupled between the first waveshaper surface 220 and the booster housing end surface 210. The remainder of the booster explosive charge 170 is positioned along the waveshaper edge 224 and the second tapered waveshaper surface 222 of the detonation waveshaper 160. As shown in FIG. 4A, the remainder of the booster explosive charge 170 is coupled between the second tapered waveshaper surface 222 and the booster housing sidewall 204 as the booster explosive charge 170 extends towards the flyer plate 190.

Figure 4B:
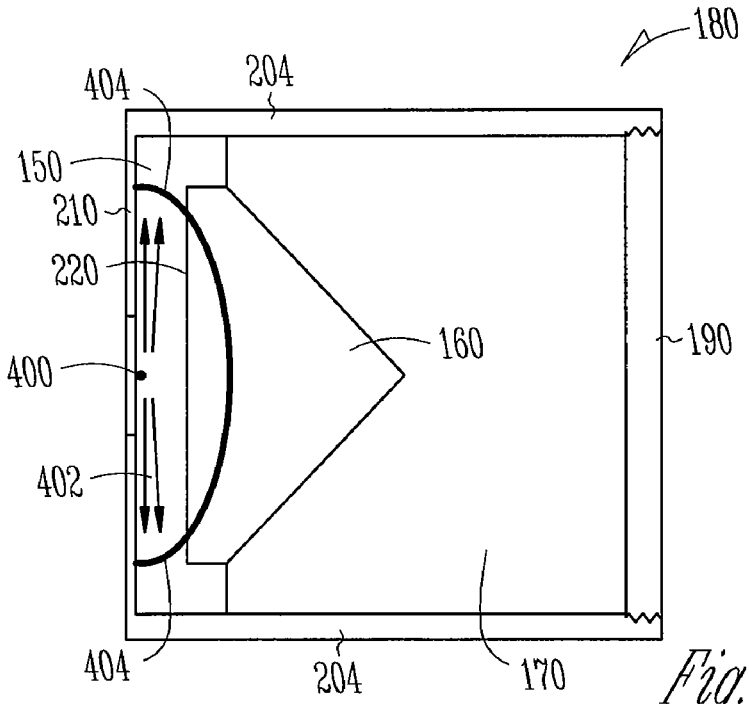
FIG. 4B is a side view of the booster housing shown in FIG. 4A with the booster explosive charge initiated and a detonation wave progressing along a first waveshaper surface.

Referring now to FIG. 4B, the transfer charge 150 is detonated. A detonation wave 402 including a detonation wave front 404 is progressing along the first waveshaper surface 220 (e.g., between the waveshaper surface 220 and booster housing end surface 210). The detonation wave 402 is thereby following a radial detonation path extending from the booster initiation lead 400 toward the booster housing sidewall 204. The detonation waveshaper 160 constrains the otherwise spherical progression of the detonation wave 402 into the radially progressing detonation wave shown in FIG. 4B. That is, the detonation waveshaper 160 is substantially preventing the spherical detonation wave 310 as shown in FIG. 3B (the example of the booster housing without the detonation waveshaper), and instead directing the detonation wave 402 radially toward the booster housing sidewall 204.

Figure 4C:
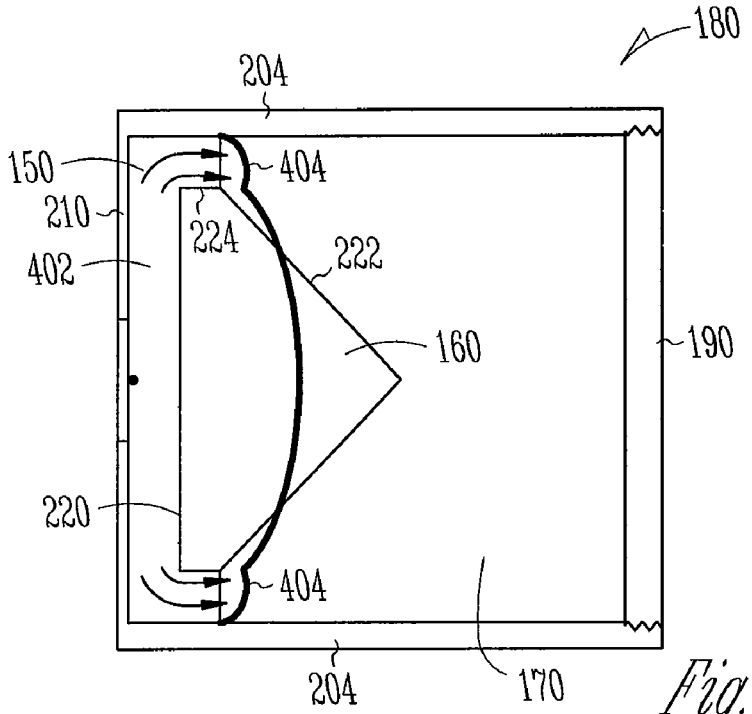
FIG. 4C is a side view of the booster housing shown in FIGS. 4A, B with the detonation wave extending around the waveshaper between first and second waveshaper surfaces.

Referring now to FIG. 4C, the detonation wave 402 continues to progress through the booster explosive charge 170 as the charge detonates. As shown the detonation wave front 404 wraps around the waveshaper edge 224 and begins to extend toward the flyer plate 190. As shown in FIG. 4C, the detonation wave front 404 progresses through the booster explosive charge 170 coupled between the waveshaper edge 224 and the booster housing sidewall 204. The detonation waveshaper 160 thereby directs the detonation wave 402 around the waveshaper 160 and along the booster housing sidewall 204 prior to directing the detonation wave 402 along the second tapered waveshaper surface 222 of the waveshaper.

Figure 4D:
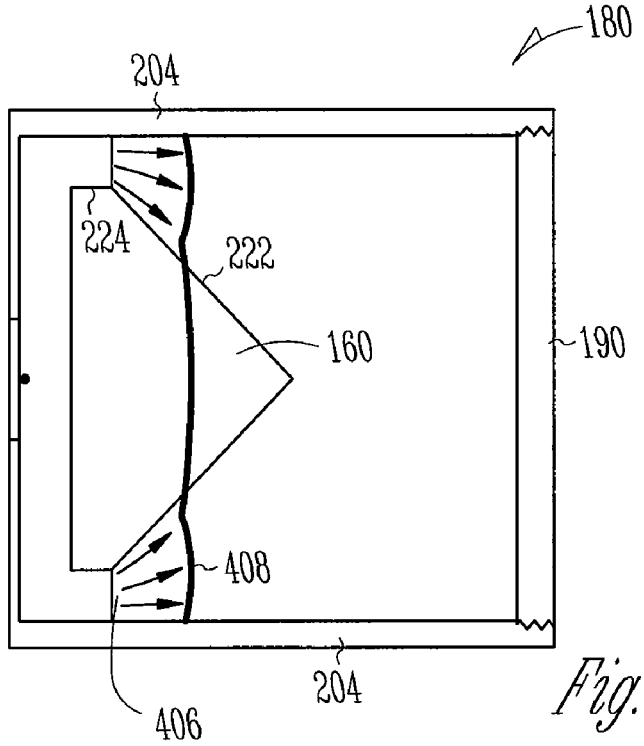
FIG. 4D is a side view of the booster housing shown in FIGS. 4A-C with the detonation wave extending along the second tapered waveshaper surface.

Referring now to FIG. 4D, the detonation wave 402 shown in FIG. 4C has transitioned into a planar detonation wave 406 having a planar detonation wave front 408. The planar detonation wave 406 and corresponding planar detonation wave front 408 are formed as the detonation wave moves along the second tapered waveshaper surface 222 between the detonation waveshaper 160 and the booster housing sidewall 204. The detonation waveshaper 160 continues to direct the planar detonation wave toward the flyer plate 190 while preventing the planar detonation wave from forming into a spherical detonation wave front as shown in FIGS. 3B and 3C.

Figure 4E:
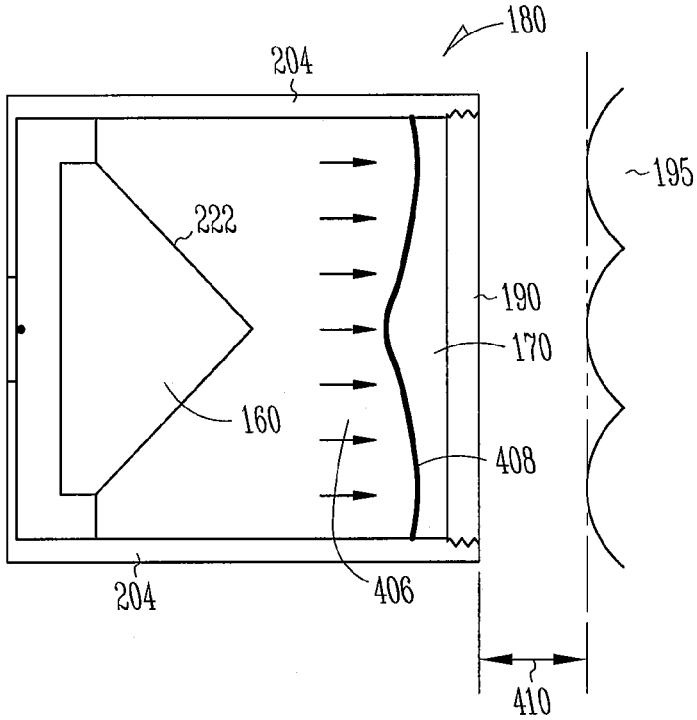
FIG. 4E is a side view of the booster housing shown in FIGS. 4A-D with the detonation wave including a planar detonation wave front formed by the waveshaper.

As shown in FIG. 4E, the planar detonation wave 406 continues to progress through the booster explosive charge 170 toward the flyer plate 190. The planar detonation wave front 408 of the planar detonation wave 406 is parallel to the flyer plate 190. That is, the planar detonation wave front 408 of the planar detonation wave 406 has a planar front in contrast to the spherical detonation wave 308 and spherical detonation wave front 310 shown in FIGS. 3B and 3C. The planar detonation wave 406 is fully contained between the detonation waveshaper 160 (e.g., the second tapered waveshaper surface 222) and the booster housing sidewall 204.

Figure 4F:
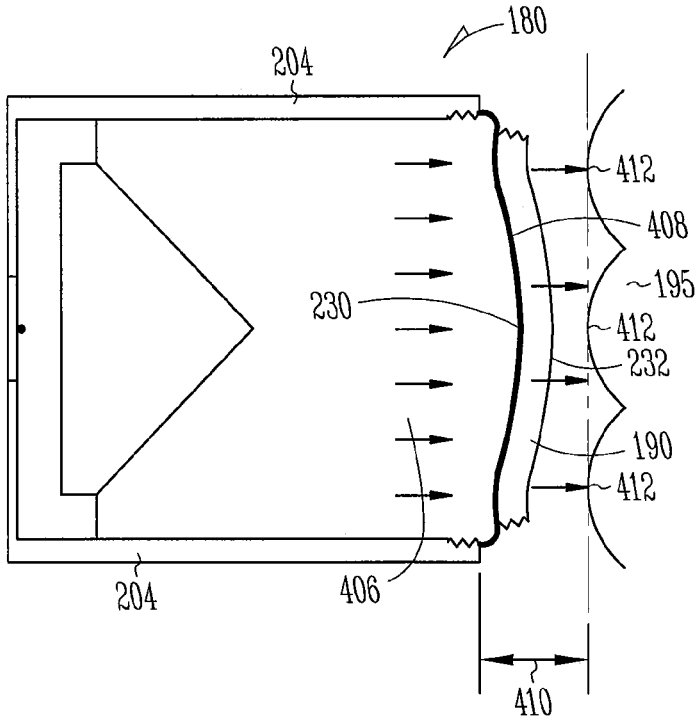
FIG. 4F is a side view of the booster housing shown in FIGS. 4A-E with the planar detonation wave front impacting against the flyer plate and projecting the flyer plate from the booster housing.

After formation of the planar detonation wave and planar detonation wave front 406, 408, respectively, the detonation waveshaper 160 and booster housing sidewall 204 maintain the planar character of the planar detonation wave 406 until it at least reaches the flyer plate 190. As shown in FIG. 4F, the planar detonation wave front 408 strikes the flyer plate 190 decoupling the flyer plate from the booster housing 180 and projecting it toward the low-sensitivity explosive charge 195. The planar character of the planar detonation wave 406 maintains the flyer plate 190 in a planar orientation relative to the planar detonation wave front 408. Additionally, because the flyer plate 190 is struck by the detonation wave front 408 as opposed to a spherical detonation wave front the flyer plate 190 is able to maintain a substantially planar orientation. Further still, the planar detonation wave front 408 of the planar detonation wave 406 substantially ensures that the flyer plate 190 is struck in a planar manner (as opposed to a spherical manner) and carried across a space 410 between the booster housing 180 and the low-sensitivity explosive charge 195 without the flyer plate 190 rotating or tipping relative to the surfaces 412 of the low-sensitivity explosive charge 195. In one example, the space 410 between the flyer plate 190 and the low-sensitivity explosive charge 195 is around 3 inches or less. Because of the planar character of the planar detonation wave 406 the flyer plate 190 is maintained in a corresponding substantially planar orientation throughout its travel through the space 410 to thereby strike the low-sensitivity explosive charge 195. In other words, the flyer plate 190 is projected from the booster housing 180 across the space 410 without any substantial deformation of the flyer plate and without any rotation or tipping of the flyer plate 190 relative to the plurality of surfaces 412 of the low-sensitivity explosive charge 195.

Figure 4G:
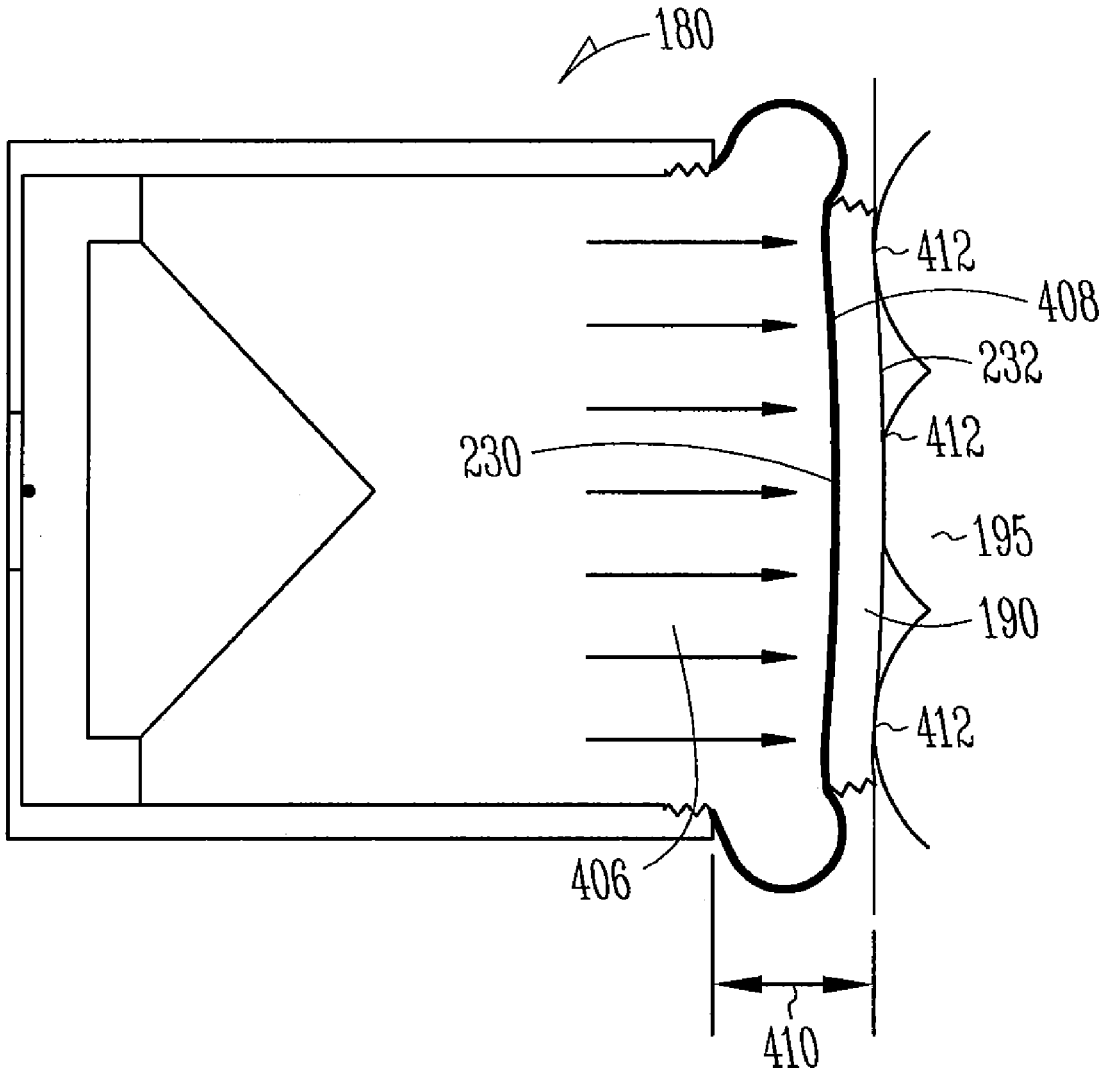
FIG. 4G is a side view of the booster housing shown in FIGS. 4A-F with the flyer plate impacting a low-sensitivity explosive charge. The planar flyer plate makes planar contact with multiple portions of the low-sensitivity charge.

FIG. 4G shows the flyer plate 190 after having traveled across the space 410 between the booster housing 180 and the low-sensitivity explosive charge 195. As shown the planar detonation wave 406 including the planar detonation wave front 408 continues to drive the flyer plate 190 into contact with the plurality of surfaces 412 of the low-sensitivity explosive charge 195. The planar detonation wave 406 strikes the flyer plate 190 on the flyer plate interior surface 230. The opposed flyer plate exterior surface 232 strikes the plurality of surfaces 412 of the low-sensitivity explosive charge 195. As shown in FIG. 4G, the flyer plate 190 makes planar contact with the plurality of surfaces 412 thereby ensuring multiple contacts with the low-sensitivity explosive charge 195 and corresponding detonation of the low-sensitivity explosive charge.

As shown in FIG. 4G, the planar detonation wave 406 including the planar detonation wave front 408 maintains the flyer plate 190 in a substantially planar orientation (without tipping or rotating) without deforming the flyer plate 190 into a shape such as the curved shape shown with the flyer plate 302 in FIG. 3C. The flyer plate exterior surface 232 is thereby able to make planar contact along multiple surfaces 412 of the low-sensitivity explosive charge 195. The flyer plate 190 makes contact with these plurality of surfaces 412 at the moment of initial contact to immediately initiate detonation of the low-sensitivity explosive charge 195 at one or more of the plurality of surfaces 412. This ensures that the low-sensitivity explosive charge 195 is able to successfully detonate in contrast to a situation where a deformed flyer plate such as flyer plate 302 is able to make point contact with only one of the surfaces of the low-sensitivity explosive charge 314 shown in FIG. 3C. plate exterior surface 232 is thereby able to make planar contact along multiple surfaces 412 of the low-sensitivity explosive charge 195. The flyer plate 190 makes contact with these plurality of surfaces 412 at the moment of initial contact to immediately initiate detonation of the low-sensitivity explosive charge 195 at one or more of the plurality of services 412. This ensures that the low-sensitivity explosive charge 195 is able to successfully detonate in contrast to a situation where a deformed flyer plate such as flyer plate 302 is able to make point contact with only one of the surfaces of the low-sensitivity explosive charge 314 shown in FIG. 3C.

Figure 5:
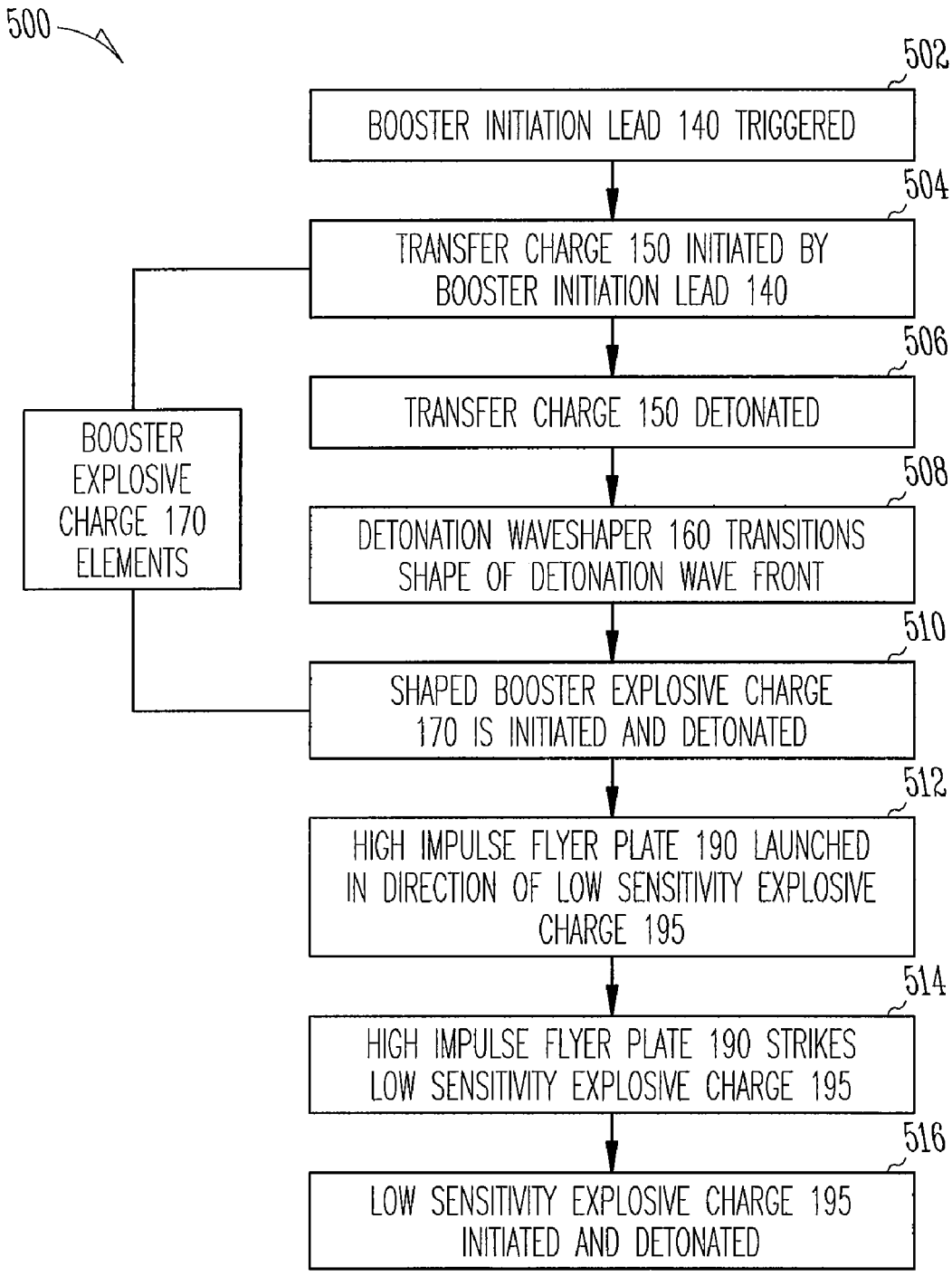
FIG. 5 is a flowchart displaying operation of a high-impulse fuze booster.

Referring now to FIG. 5, one example of a method for using the high-impulse fuze system such as the high impulse fuze booster system 100 shown in FIG. 1 is shown. Reference is made in the description of the method 500 to elements of the high end fuze booster system 100 shown in FIG. 1 and described in FIGS. 2 and 4A through 4G. At 502, a booster initiation lead 140 (such as the booster initiation lead 140 shown in FIG. 1) is triggered. Referring to FIG. 1, the booster initiation lead 140 is in communication with the booster explosive charge 170 including the transfer charge 150 shown in FIG. 1. At 504, the transfer charge 150 is initiated by the booster initiation lead 140. After initiation of the transfer charge 150, at 506, transfer charge 150 is detonated and the detonation wave 402 radially progresses across the first waveshaper surface 220 toward the booster housing sidewall 204. The detonation wave 402 continues toward the booster housing sidewall 204 and wraps around the detonation waveshaper 160 (as shown in FIG. 4C) and begins to travel along the second tapered waveshaper surface 222 of the detonation waveshaper 160. At 508, as shown in FIGS. 4B-4E, the detonation waveshaper 160 transitions the shape of the detonation wave front, such as the detonation wave front 404 initially shown in FIG. 4B, to a planar detonation wave front 408 as shown in FIGS. 4D-4F. At 510, the shaped booster explosive charge 170 is initiated and detonated by the planar detonation wave 406 and planar detonation wave front 408 progressing toward the flyer plate 190.

At 512, the high-impulse flyer plate 190 is projected or launched in the direction of the low-sensitivity explosive charge 195 as shown in FIG. 4F. As previously described, the planar detonation wave 406 and the corresponding planar detonation wave front 408 strike the high-impulse flyer plate 190 along the flyer plate interior surface 230. The planar detonation wave front 408 makes planar contact with the flyer plate 190, thereby preserving the flyer plate 190 substantially in its original shape. The planar detonation wave front 408 further maintains the flyer plate 190 in a substantially parallel orientation relative to a plurality of surfaces 412 of the low-sensitivity explosive charge 195 shown in FIG. 4F.

At 514, the high-impulse flyer plate 190 strikes the low-sensitivity explosive charge 195 at, for instance, the plurality of surfaces 412 of the charge 195. Because the planar detonation wave 406 maintains the flyer plate 190 in the planar configuration without rotating or tipping the flyer plate 190 the flyer plate makes planar contact with the plurality of surfaces 412. At 516, because of the multiple planar contacts with the plurality of surfaces 412 of the low-sensitivity explosive charge 195, the charge 195 is initiated at one or more of the surfaces 412 and detonated. That is, the multiple contacts with the low-sensitivity explosive charge 195 occur at the same moment and ensure immediate initiation and detonation of the low-sensitivity explosive charge. In contrast to the planar contact shown in FIG. 4F, the point contact of the curved flyer plate 302 shown in FIG. 3C fails to ensure initiation and detonation of the low-sensitivity explosive charge 314 because the flyer plate 302 is only able to make a single point contact with the charge 314.

Several options for the method 500 follow. In one example, directing the detonation wave 402 through the booster housing 180 along the first waveshaper surface 220 includes directing the detonation wave 402 radially away from the booster initiation lead 140 toward the booster housing sidewall 204. In another example, directing the planar detonation wave 406 along the second tapered waveshaper surface 222 includes expanding the planar detonation wave 406 between the second tapered waveshaper surface 222 and the booster housing sidewall 204 as the detonation wave 406 moves toward the flyer plate 190. In still another example, projecting the flyer plate 190 away from the booster housing 180 toward the low-sensitivity explosive charge 195 includes projecting the flyer plate across the space (such as space 410 shown in FIG. 4G) between the booster housing 180 and the low-sensitivity explosive charge 195. Projecting the flyer plate 190 across the space 410 includes the planar detonation wave front 408 maintaining the flyer plate 190 substantially parallel to the plurality of surfaces 412 of the low-sensitivity explosive charge 195. The flyer plate 190 is maintained in this orientation and strikes the plurality of surfaces 412 at the moment of initial contact with the low-sensitivity explosive charge 195.

In yet another example, projecting the flyer plate 190 away from the booster housing 180 toward the low-sensitivity explosive charge 195 includes the flyer plate maintaining a substantially planar configuration such as the configuration shown in FIGS. 4F and 4G without curving deformation (e.g., the configuration shown in FIG. 3C) after the flyer plate 190 is struck by the planar detonation wave 406 and wave front 408 and until the flyer plate 190 impacts the low-sensitivity explosive charge 195. Optionally, the method 500 further includes containing the planar detonation wave 406 within the booster housing 180 until the flyer plate 190 is struck. Method 500 further includes, in another example, constraining the planar detonation wave 406 to exit the booster housing 180 substantially through a booster housing end portion opened by the flyer plate 190 projecting away from the booster housing.

CONCLUSION

The detonation waveshaper shown in the attached figures and specification transforms an otherwise spherical detonation wave into a planar detonation wave for striking a flyer plate. Impacting the flyer plate with a planar wave front projects the flyer plate away from the booster housing in a substantially undeformed shape parallel to a planar surface defined across a plurality of surfaces of the low-sensitivity explosive charge. Additionally, the planar detonation wave ensures that the flyer plate projects toward the low-sensitivity explosive charge in a planar orientation substantially parallel to a plurality of surfaces of the low-sensitivity explosive charge. The flyer plate is thereby able to make multiple contacts with the various surfaces of the low-sensitivity explosive charge and strike those surfaces to begin initiation and detonation of the low-sensitivity explosive charge. In contrast to the spherical detonation wave of a booster housing without a detonation waveshaper, the waveshaper shown in the drawings and described above directs the detonation wave through the booster housing and around the detonation waveshaper to transform the detonation wave into a planar detonation wave for impacting and controlling the projection of the flyer plate from the booster housing.

Further, because the flyer plate is struck by the planar detonation wave front and maintained in a planar orientation and shape without any substantial deformation thereof the flyer plate is able to cross spaces between the booster housing and the low-sensitivity explosive charge when the low-sensitivity explosive charge settles away from the booster housing during impact of the munition with a target. The flyer plate is able to cross the space between the booster housing and the low-sensitivity explosive charge while maintaining an orientation parallel to the plurality of surfaces of the low-sensitivity explosive charge. The flyer plate makes contact with multiple surfaces of the low-sensitivity explosive charge and initiates detonation of the low-sensitivity explosive charge after having crossed the gap. That is to say because of the planar detonation wave the flyer plate does not rotate or tilt relative to the low-sensitivity explosive charge while crossing the space between the booster housing and the charge to facilitate planar contact between the flyer plate and multiple surfaces of the low-sensitivity explosive charge.

The particular implementations shown and described are illustrative of the subject matter and its best mode and are not intended to otherwise limit the scope of the present subject matter in any way. Indeed, for the sake of brevity, conventional manufacturing, connection, preparation, and other functional aspects of the system may not be described in detail. Furthermore, the connecting lines shown in the various figures are intended to represent exemplary functional relationships and/or physical couplings between the various elements. Many alternative or additional functional relationships or physical connections may be present in a practical system.

In the foregoing description, the subject matter has been described with reference to specific exemplary examples. However, it will be appreciated that various modifications and changes may be made without departing from the scope of the present subject matter as set forth herein. The description and figures are to be regarded in an illustrative manner, rather than a restrictive one and all such modifications are intended to be included within the scope of the present subject matter. Accordingly, the scope of the subject matter should be determined by the generic examples described herein and their legal equivalents rather than by merely the specific examples described above. For example, the steps recited in any method or process embodiment may be executed in any order and are not limited to the explicit order presented in the specific examples. Additionally, the components and/or elements recited in any apparatus embodiment may be assembled or otherwise operationally configured in a variety of permutations to produce substantially the same result as the present subject matter and are accordingly not limited to the specific configuration recited in the specific to examples.

Benefits, other advantages and solutions to problems have been described above with regard to particular embodiments; however, any benefit, advantage, solution to problems or any element that may cause any particular benefit, advantage or solution to occur or to become more pronounced are not to be construed as critical, required or essential features or components.

As used herein, the terms “comprises”, “comprising”, or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present subject matter, in addition to those not specifically recited, may be varied or otherwise particularly adapted to specific environments, manufacturing specifications, design parameters or other operating requirements without departing from the general principles of the same.

The present subject matter has been described above with reference to an example embodiment. However, changes and modifications may be made to the example embodiment without departing from the scope of the present subject matter. These and other changes or modifications are intended to be included within the scope of the present subject matter, as expressed in the following claims.

It is to be understood that the above description is intended to be illustrative, and not restrictive. Many other embodiments will be apparent to those of skill in the art upon reading and understanding the above description. It should be noted that embodiments discussed in different portions of the description or referred to in different drawings can be combined to form additional embodiments of the present application. The scope of the subject matter should, therefore, be determined with reference to the appended claims, along with the full scope of equivalents to which such claims are entitled.

What is claimed is:

1. A munition including a high-impulse fuze booster system, the high-impulse fuze booster comprising:

a booster explosive charge positioned within an explosive charge cavity of a booster housing;

a detonation waveshaper positioned within the booster explosive charge and interposed between a booster initiation lead and a flyer plate, the detonation waveshaper includes a first waveshaper surface extending over and away from the booster initiation lead and a second tapered waveshaper surface tapering toward the flyer plate, wherein one or more detonation paths extend across the first waveshaper surface and around the detonation waveshaper between the first waveshaper surface and second tapered waveshaper surface, and the one or more detonation paths extend over the second tapered waveshaper surface toward the flyer plate; and wherein the flyer plate is a substantially continuous planar plate extending across the booster housing.

2. The munition including a high-impulse fuze booster system of claim 1 further comprising a fuze housing including a booster initiation lead positioned along a fuze housing perimeter, and the booster housing includes a lead orifice and the booster initiation lead extends from the fuze housing into the explosive charge cavity through the lead orifice.

3. The munition including the high-impulse fuze booster system of claim 2, wherein the booster housing is integral to the fuze housing.

4. The munition including the high-impulse fuze booster system of claim 1, wherein the booster explosive charge includes a transfer charge, and the transfer charge extends along the first waveshaper surface toward a booster housing sidewall of the booster housing, and the detonation path extends through the transfer charge toward the booster housing sidewall.

5. The munition including the high-impulse fuze booster system of claim 1, wherein the one or more detonation paths extending across the first waveshaper surface extend radially outward from near the booster initiation lead toward a booster housing sidewall.

6. The munition including the high-impulse fuze booster system of claim 1, wherein the one or more detonation paths extending over the second tapered waveshaper surface extend radially inward from the booster housing sidewall.

7. The munition including the high-impulse fuze booster system of claim 1, wherein the flyer plate includes a first inner surface facing the booster explosive charge and the detonation waveshaper, and the first inner surface tapers from near the booster housing sidewall toward a flyer plate apex.

8. The munition including the high-impulse fuze booster system of claim 1, wherein the detonation waveshaper includes:

a waveshaper body including the second tapered waveshaper surface, and a waveshaper insert coupled along the waveshaper body, the waveshaper insert includes the first waveshaper surface, and the waveshaper body and the waveshaper insert are made of different materials.

9. The munition including the high-impulse fuze booster system of claim 8, wherein at least one of the waveshaper insert and the waveshaper body is denser than the other of the waveshaper body and the waveshaper insert.

10. A munition including a high-impulse fuze booster system, the high-impulse fuze booster comprising:

a booster explosive charge positioned within an explosive charge cavity of a booster housing;

a substantially planar flyer plate coupled with the booster housing;

a detonation waveshaper positioned within the booster explosive charge, the detonation waveshaper includes a first waveshaper surface near a booster housing end wall, the detonation waveshaper includes a second tapered waveshaper surface between the substantially planar flyer plate and the first waveshaper surface; and the booster explosive charge is configured to generate a detonation wave and the detonation wave moves over the detonation waveshaper in one or more stages including:

a first detonation stage where the detonation wave begins in the booster explosive charge near the booster housing end wall and moves along the first waveshaper surface, a second detonation stage where the detonation wave moves around the detonation waveshaper between the first waveshaper surface and the second tapered waveshaper surface, and a third detonation stage where the detonation wave moves over the second tapered waveshaper surface toward the substantially planar flyer plate, and the detonation wave in the third detonation stage includes a planar detonation wave front directed by the waveshaper, and the planar detonation wave front is substantially parallel to a first interior face of the substantially planar flyer plate.

11. The munition including the high-impulse fuze booster system of claim 10, wherein the booster explosive charge includes a transfer charge extending over the first waveshaper surface toward a booster housing sidewall, and the transfer charge is between the booster housing end wall and the first waveshaper surface.

12. The munition including the high-impulse fuze booster system of claim 10, wherein the booster explosive charge extends around the detonation waveshaper near a booster housing sidewall.

13. The munition including the high-impulse fuze booster system of claim 10, wherein the booster explosive charge extends between a booster housing sidewall and the second tapered waveshaper surface from near the booster housing end wall toward the substantially planar flyer plate.

14. The munition including the high-impulse fuze booster system of claim 10, wherein the first waveshaper surface extends from a booster initiation lead toward a booster housing sidewall, and the second tapered waveshaper surface extends from near the booster housing sidewall toward the substantially planar flyer plate.

15. The munition including the high-impulse fuze booster system of claim 10, wherein the detonation waveshaper is surrounded by the booster explosive charge.

16. The munition including the high-impulse fuze booster system of claim 10 further comprising a munition housing, and the munition housing contains at least one of the booster housing and a fuze housing coupled with the booster housing.

17. The munition including the high-impulse fuze booster system of claim 16, wherein the munition housing includes a low-sensitivity explosive charge separated from the second exterior face of the substantially planar flyer plate by a space, and in a striking condition the substantially planar flyer plate is configured to move across the space and strike the low-sensitivity explosive charge when impacted by the planar detonation wave front, the second exterior face of the substantially planar flyer plate makes immediate planar contact along a plurality of surfaces of the low-sensitivity explosive charge to initiate the low-sensitivity explosive charge.

18. The munition including the high-impulse fuze booster system of claim 17, wherein the substantially planar flyer plate includes the first interior face directed toward the booster explosive charge and the second exterior face, and the first interior and second exterior faces of the substantially planar flyer plate are substantially parallel to the planar detonation wave front before, during and after impact by the planar detonation wave front.

19. A method of making a munition including a high-impulse fuze booster system, the method comprising:

positioning a detonation waveshaper within an explosive charge cavity of a booster housing, the detonation waveshaper includes a first waveshaper surface extending along a booster housing first end portion, and the detonation waveshaper includes a second tapered waveshaper surface tapering toward a booster housing second end portion;

positioning a booster explosive charge within the explosive charge cavity, the booster explosive charge extends across the first waveshaper, and the booster explosive charge extends around the detonation waveshaper from the first waveshaper surface over the second tapered waveshaper surface toward the second end portion of the booster housing; and coupling a planar flyer plate over the explosive charge cavity at the second end portion of the booster charge cavity, and the detonation waveshaper is configured to direct a planar detonation wave front into the planar flyer plate, the planar detonation wave front is substantially parallel to an interior face of the planar flyer plate.

20. The method of claim 19 further comprising coupling the booster housing assembly with a fuze housing.

21. The method of claim 19, wherein positioning the booster explosive charge within the explosive charge cavity includes coupling the booster explosive charge between the booster housing first end portion and the first waveshaper surface, and the booster explosive charge extends along the first waveshaper surface toward a booster housing sidewall.

22. The method of claim 19, wherein positioning the booster explosive charge within the explosive charge cavity includes coupling the booster explosive charge between the detonation waveshaper and a booster housing sidewall where the booster explosive charge extends around the detonation waveshaper.

23. The method of claim 19, wherein positioning the booster explosive charge within the explosive charge cavity includes coupling the booster explosive charge between the second tapered waveshaper surface of the detonation waveshaper and a booster housing sidewall.

24. The method of claim 19 further comprising coupling a waveshaper insert along a waveshaper body including the second tapered waveshaper surface, and the waveshaper insert includes the first waveshaper surface.

25. The method of claim 19, wherein positioning the booster explosive charge within the explosive charge cavity includes surrounding the detonation waveshaper with the booster explosive charge.

26. The method of claim 19 further comprising positioning the booster housing assembly and the fuze housing within a munition housing, and the munition housing includes a low-sensitivity explosive charge adjacent to an exterior face of the planar flyer plate.

27. A method of using a munition including a high-impulse fuze booster system, the method comprising:

initiating a booster explosive charge within an explosive charge cavity in a booster housing;

generating a planar detonation wave including:

directing a detonation wave through the booster housing along a first waveshaper surface of a detonation waveshaper;

directing the detonation wave around the first waveshaper surface toward a second tapered waveshaper surface;

directing the detonation wave along the second tapered waveshaper surface, and the detonation wave changes into a planar detonation wave as the detonation wave moves along the second tapered waveshaper surface, and the planar detonation wave includes a planar wave front; and striking a planar flyer plate coupled over the explosive charge cavity of the booster housing with the planar detonation wave, and the planar wave front makes planar contact along an inner face of the planar flyer plate, wherein the planar wave front is substantially parallel to the planar flyer plate.

28. The method of claim 27, wherein directing the detonation wave through the booster housing along the first waveshaper surface includes directing the detonation wave radially away from a booster initiation lead toward a booster housing sidewall.

29. The method of claim 27, wherein directing the detonation wave along the second tapered waveshaper surface includes expanding the detonation wave between the second tapered waveshaper surface and a booster housing sidewall as the detonation wave moves toward the planar flyer plate.

30. The method of claim 27 further comprising containing the planar detonation wave within the booster housing until striking of the planar flyer plate, and constraining the planar detonation wave to exit the booster housing substantially through a booster housing end portion opened by the planar flyer plate projecting away from the booster housing.

31. The method of claim 27 further comprising projecting the planar flyer plate away from the booster housing toward a low-sensitivity explosive charge, the planar flyer plate remains substantially parallel to the planar wave front throughout movement from the booster housing to the low-sensitivity explosive charge.

32. The method of claim 31, wherein projecting the planar flyer plate away from the booster housing toward the low-sensitivity explosive charge includes projecting the planar flyer plate across a space between the booster housing and the low-sensitivity explosive charge.

33. The method of claim 32, wherein projecting the planar flyer plate across the space includes the planar wave front maintaining the exterior face of the planar flyer plate substantially parallel to the plurality of surfaces of the low-sensitivity explosive charge at the moment of contact with the low-sensitivity explosive charge.

34. The method of claim 31, wherein projecting the planar flyer plate away from the booster housing toward the low-sensitivity explosive charge includes the flyer plate maintaining a substantially planar configuration without warping deformation of the planar flyer plate after the planar flyer plate is struck by the planar detonation wave and until the planar flyer plate impacts the low-sensitivity explosive charge.

35. The method of claim 27 further comprising impacting the planar flyer plate with a low-sensitivity explosive charge, and an exterior face of the planar flyer plate makes planar contact with a plurality of surfaces of the low-sensitivity explosive charge at the moment of contact to immediately initiate detonation of the low-sensitivity explosive charge at one or more of the plurality of surfaces.

* * * * *

UNITED STATES PATENT AND TRADEMARK OFFICE

CERTIFICATE OF CORRECTION

PATENT NO. : 8,056,478 B2
APPLICATION NO. : 12/429811
DATED : November 15, 2011
INVENTOR(S) : Bryan F. Berlin and Kim L. Christianson It is certified that error appears in the above-identified patent and that said Letters Patent is hereby corrected as shown below:

In column 12, lines 53-64, after "FIG. 3C." delete "plate exterior surface 232 is thereby able to make planar contact along multiple surfaces 412 of the low-sensitivity explosive charge 195. The flyer plate 190 makes contact with these plurality of surfaces 412 at the moment of initial contact to immediately initiate detonation of the low-sensitivity explosive charge 195 at one or more of the plurality of services 412. This ensures that the low-sensitivity explosive charge 195 is able to successfully detonate in contrast to a situation where a deformed flyer plate such as flyer plate 302 is able to make point contact with only one of the surfaces of the low-sensitivity explosive charge 314 shown in FIG. 3C".

In column 15, line 35, after "specific" delete "to".

Signed and Sealed this
Twenty-first Day of February, 2012

David J. Kappos

David J. Kappos
*Director of the United States Patent and Trademark Office*

UNITED STATES PATENT AND TRADEMARK OFFICE

CERTIFICATE OF CORRECTION

PATENT NO. : 8,056,478 B2
APPLICATION NO. : 12/429811
DATED : November 15, 2011
INVENTOR(S) : Bryan F. Berlin et al.

It is certified that error appears in the above-identified patent and that said Letters Patent is hereby corrected as shown below:

In column 1, line 13, below "entirety." insert

--GOVERNMENT RIGHTS

This invention was made with United States Government support under Contract Number WITHHELD. The United States Government has certain rights in this invention.--.

Signed and Sealed this
Tenth Day of April, 2012

David J. Kappos

David J. Kappos
*Director of the United States Patent and Trademark Office*